US012053058B2

(12) United States Patent
Jungkind

(10) Patent No.: US 12,053,058 B2
(45) Date of Patent: Aug. 6, 2024

(54) ROTARY CLOSURE WITH TENSIONING ELEMENT

(71) Applicant: PUMA SE, Herzogenaurach (DE)

(72) Inventor: Roland Jungkind, Garmisch-Partenkirchen (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 17/766,701

(22) PCT Filed: Oct. 5, 2020

(86) PCT No.: PCT/EP2020/077772
§ 371 (c)(1),
(2) Date: Apr. 5, 2022

(87) PCT Pub. No.: WO2021/069341
PCT Pub. Date: Apr. 15, 2021

(65) Prior Publication Data

US 2024/0065382 A1 Feb. 29, 2024

(30) Foreign Application Priority Data

Oct. 10, 2019 (DE) ..... 20 2019 105 576.6

(51) Int. Cl.
*A43C 11/16* (2006.01)
*A41F 1/00* (2006.01)
*A45C 13/10* (2006.01)

(52) U.S. Cl.
CPC ..... *A43C 11/165* (2013.01); *A41F 1/00* (2013.01); *A45C 13/10* (2013.01)

(58) Field of Classification Search
CPC ..... A43C 11/165; A43C 11/16; A43C 11/00; A41F 1/00; A45C 13/10; F16G 11/12
See application file for complete search history.

(56) References Cited

U.S. PATENT DOCUMENTS 5,042,177 A * 8/1991 Schoch ..... A43C 11/165 36/50.1
5,152,038 A * 10/1992 Schoch ..... A43C 11/165 242/400

(Continued)

FOREIGN PATENT DOCUMENTS

DE 3926514 A1 2/1991
KR 10-2015-0131485 A 11/2015

(Continued)

OTHER PUBLICATIONS

International Search Report of International Application No. PCT/EP2020/077772, mailed Oct. 5, 2020, 6 pages.

(Continued)

*Primary Examiner* — Robert Sandy
*Assistant Examiner* — Louis A Mercado
(74) *Attorney, Agent, or Firm* — Quarles & Brady LLP

(57) ABSTRACT

The disclosure relates to a rotary closure including a housing part with an axis to which a rotary knob is attached in order to actuate a tensioning roller for a tensioning element for the rotary closure in order to wind or release the tensioning element. Further, a first gear is connected to the rotary knob and has internal toothing and a second gear is rotationally connected to the tensioning roller and has internal toothing. Additionally, a drive pinion that is coupled to the gears is provided between said first and second gears, and the drive pinion has a mounting that is configured to be radially moved relative to the drive axis in order to selectively couple the pinion to and release the pinion from the internal toothing of the respective first and second gears.

8 Claims, 6 Drawing Sheets

(56) References Cited

U.S. PATENT DOCUMENTS

| | | | | |
|---|---|---|---|---|
| 5,600,874 | A * | 2/1997 | Jungkind | A43C 11/165 24/71 SK |
| 10,477,924 | B2 * | 11/2019 | Midorikawa | A43C 11/165 |
| 2008/0223972 | A1 * | 9/2008 | Kovacevich | F16G 11/12 242/410 |
| 2015/0007422 | A1 | 1/2015 | Cavanagh | |
| 2017/0311682 | A1 * | 11/2017 | Trudel | F16G 11/12 |

FOREIGN PATENT DOCUMENTS

| | | | | |
|---|---|---|---|---|
| WO | 2001011948 | A1 | 2/2001 | |
| WO | 2014001918 | A1 | 1/2014 | |
| WO | WO-2014082652 | A1 * | 6/2014 | A43C 11/16 |

OTHER PUBLICATIONS

Written Opinion of International Application No. PCT/EP2020/077772, mailed Oct. 5, 2020, 5 pages.

* cited by examiner

B-B

ROTARY CLOSURE WITH TENSIONING ELEMENT

This application is a U.S. National Stage application, filed pursuant to 35 U.S.C. § 371, of international application no. PCT/EP2020/077772, filed on Oct. 5, 2020, which claims the benefit of priority of German utility model application no. 202019105576.6, filed on Oct. 10, 2019, the contents of which are incorporated herein by reference in their entirety.

The present invention relates to a rotary closure for a sports article, a piece of luggage or a shoe, in particular a sports shoe, in which closure a tensioning element can be tensioned via a tensioning roller within a housing and can be released again as required to open the closure. Such a rotary closure is used, for example, for sports shoes in order to avoid a classical lacing of a shoelace and to bring about a closure of the shoe opening effected solely by turning. Such rotary closures are usually realized with tensioning elements made of plastic in the form of thin cables which slide in eyelets provided for this purpose or in the upper material of the shoe. However, such rotary closures can also be used in other fields, such as bags, luggage or articles of clothing Such rotary locks are not limited in their application to the footwear sector alone.

In the prior art, various such rotary closures with cable-like tensioning elements have been described. For example, a rotary closure for a sports shoe is known from WO 2014/082652 A1, in which a tensioning pulley mounted in a housing is provided for lacing the shoe by means of a tensioning element which is wound up therein. The closure is actuated by means of a rotary knob, the closure comprising internally a pawl with a locking toothing, wherein in order to disengage the toothing from the outside, a locking lever must be actuated by a counterclockwise rotation. The number of components required for this rotary closure is comparatively high, and handling is comparatively awkward for the user, who has to operate a locking lever or locking knob extra at certain points to release the closure and open the shoe.

In contrast, it is the object of the present disclosure—to provide a rotary closure for such applications with a tensioning element, which is easy to operate and has a very compact design with as few components as possible. At the same time, the rotary closure is intended to enable secure closing and opening, even in the long term.

This object is solved with a rotary closure having the features described herein. Advantageous embodiments and further developments are the subject of the dependent claims.

According to the present disclosure, there is provided a rotary closure for a sports article, e.g., a sports shoe, which comprises a housing part with an axis to which a rotary knob is attached for actuating a tensioning pulley for a tensioning element, e.g., a cable, for the closure for winding on or releasing the tensioning element, as well as a first gear or wheel with internal toothing connected to the rotary knob and a rotating second gear or wheel with internal toothing connected to the tensioning roller, the rotary closure being characterized in that a drive pinion which can be-coupled thereto is provided between the first and second gears, and in that the drive pinion has a mounting which can be displaced radially with respect to the drive axis for selective coupling to and uncoupling from the internal toothing of the first and second gear wheels.

According to the present disclosure, a drive pinion is thus provided, i.e., a gear which is significantly smaller than the gears and which can be coupled to the gears with internal toothing. The drive pinion is installed with a specific mounting in the rotary closure, namely a mounting which permits coupling and decoupling (disengagement) with the internal toothing of the gears. The drive pinion is thus not installed in a fixed position in the housing part of the rotary closure, but can be selectively displaced or relocated in order to effect coupling and decoupling of the drive gearing depending on the operating situation. A displaceable mounting arrangement of the drive pinion can thereby take any form of displaceable bearing arrangement on such rotary axes for pinions. The mounting only has to be designed so that it can be displaced or changed in such a way that, when displaced, coupling and disengagement with the gears is made possible. In the coupled state, the drive pinion thus serves to connect the internal toothing of the stationary first gear with the internal toothing of the second rotating gear, which in turn actuates the tensioning pulley of the tensioning element. Thus, by simply turning the rotary knob, the tensioning element can be tensioned with great force and likewise, by simply turning it in another direction, for example, the connection between the pinion and the internal toothing can be immediately released, that is, the tensioning element can be released and thus the closure can then be reopened in a very simple manner. The rotary closure according to the present disclosure is very compact due to its low overall height and width dimension, and comprises a comparatively small number of required parts and components. This greatly reduces the susceptibility to malfunction. The rotary closure can also be used in situations in which a cumbersome form of operation is not so feasible. Last but not least, the manufacturing costs are greatly reduced compared to previously known rotary closures of this type.

According to an advantageous embodiment, the mounting of the drive pinion can be moved radially by changing the direction of rotation on the rotary knob. Thus, the closure can be released again by simply changing the direction of rotation at the rotary knob. A clockwise direction of rotation, for example, serves to close and tighten the closure by winding up the tensioning element. Turning the knob in the opposite direction to the clockwise direction, for example, allows the shutter to be released easily. The drive pinion is simply shifted radially inwards in its mounting by changing the direction of rotation on the rotary knob. This means that no additional actuating elements are required to open the closure. Operation is also very intuitive for the user due to such a reversal of the direction of rotation.

According to an advantageous embodiment, the mounting of the drive pinion has an arcuate pitch circle groove or an arcuate slot which changes in distance over its course with respect to the axis. Thus, the mounting of the drive pinion can also be displaced with respect to the internal toothing, for example by deliberately displacing a bearing pin of the drive pinion in the pitch circle groove or slot and, for example, displacing it inwards towards the axis of the rotary closure. With such a change in spacing, engagement and disengagement from the internal toothings can be effected easily by the drive pinion using mechanically inexpensive components. Also, with such an arcuate pitch circle groove or slot, a very compact design, especially a very flat shape of the rotary closure, can be realized. According to an alternative embodiment, the pitch circle groove can be composed of a first section, which is concentric with the axis of the rotary closure, and a second section, which is no longer concentric therewith but extends inwards. This achieves a secure function, since the toothing does not immediately "open" every time the rotary knob is turned slightly.

According to a further advantageous embodiment, the mounting of the drive pinion is provided in an intermediate housing inside the housing part of the rotary closure. Such an intermediate housing can be realized, for example, in the form of a U-shaped sheet metal part with a very thin design. Varying the distance of the mounting from the drive pinion to the toothing of the gears can thus be easily realized within the housing. The mounting elements are not complex components requiring time-consuming manufacturing steps and assembly work.

According to another advantageous embodiment, the number of teeth of the gears from the two internal gears, at the same core diameter, varies slightly, at least by one tooth. The difference in teeth can also be two, three or four teeth. By slightly varying the number of teeth of the two gears, namely the gear connected to the rotary closure with the rotary knob and the gear connected to the tensioning pulley, a kind of self-locking can be produced in cooperation with the drive pinion. The rotary closure is thus formed in a quasi self-locking manner, and unintentional displacement of the rotary closure is prevented. The number of teeth and also the number of toothings can vary as long as the two toothings of the gears ensure essentially the same coupling with the drive pinion.

According to a further advantageous embodiment, the drive pinion has a comparatively large reduction ratio with respect to the gears in a range of about 1:3 and the drive pinion rotates on a circular path around the stationary gear. With such a large reduction ratio, a large reduction can be realized on a very small size, which is required for effective tensioning of the tensioning element. It also allows greater forces to be applied to the tensioning element compared to a lower reduction or gear ratio. For example, if the first gear on the housing has twenty-seven teeth, the second gear on the tensioning wheel has twenty-four teeth, and the pinion has nine teeth, a total reduction ratio of 1:8 can be realized.

According to a further advantageous embodiment, the gears are substantially completely enclosed from the outside by the housing part of the rotary closure. The gears are therefore essentially inside a sealed housing and are thus protected from external interference and damage.

According to a further advantageous embodiment, the mounting of the drive pinion runs eccentrically to an axis center of the drive axis of the rotary closure. With such an eccentrically extending bearing part, the drive pinion can also be disengaged from and re-engaged in the teeth of the internal gearing in a different manner than is the case with an arcuate slot or groove. The mounting is simply realized eccentrically in relation to the center of the drive axle and can, for example, also have a rectilinear shape or other design than previously described.

Further features, aspects, advantages and embodiments—are described in more detail below with reference to the embodiments shown in the accompanying drawings.

FIG. 1*a,*

FIG. 1*b,*

FIG. 1*c* and

FIG. 1*d* show a side view, a cross-sectional view, a longitudinal sectional view and a top view from above of a first embodiment of a rotary closure with a displaceable drive pinion;

FIG. 4*b,*

FIG. 4*c,*

FIG. 4*d,*

FIG. 4*e* and

Figures 4A, 4B, 4C:
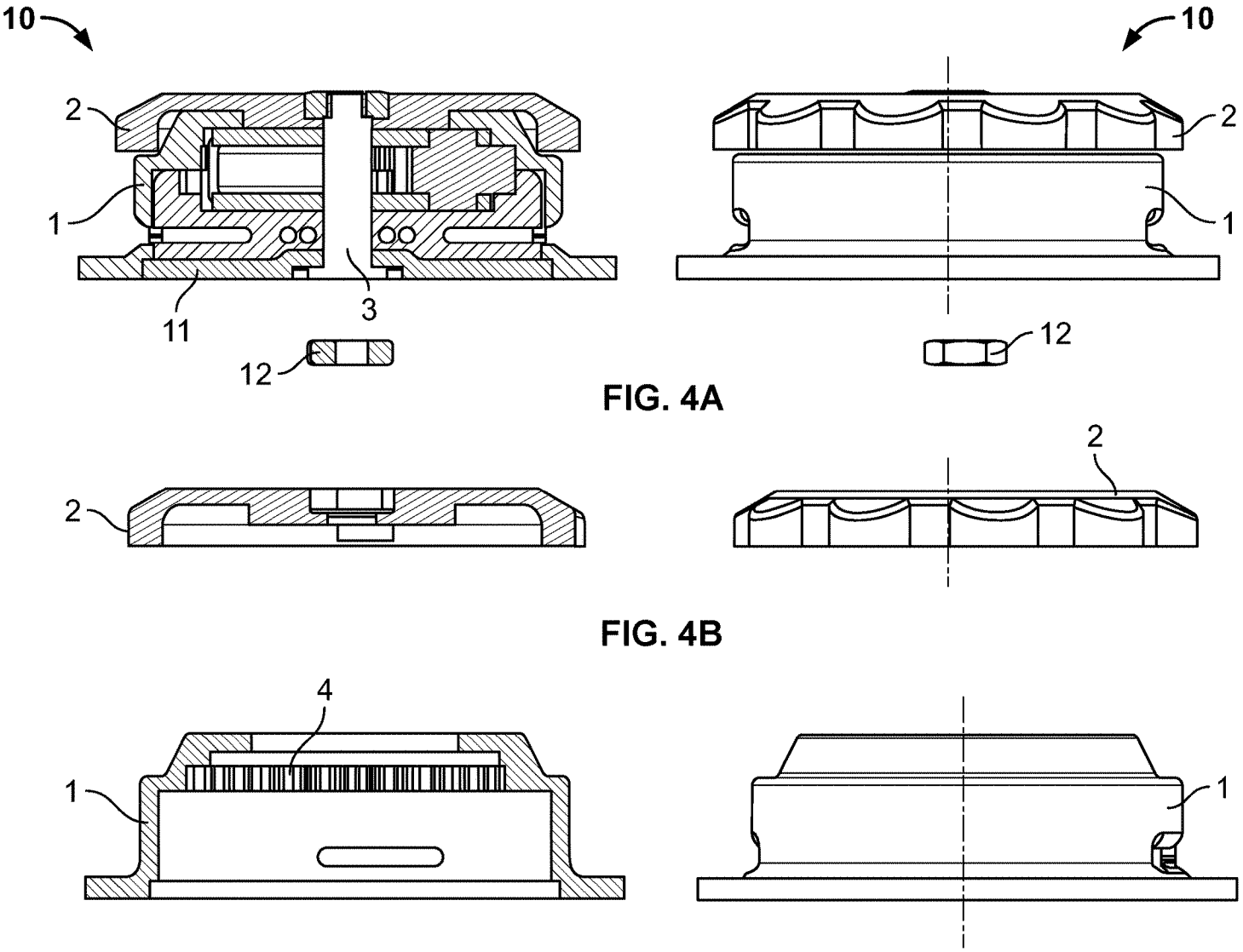
FIG. 4*a,*
Figure 4D:
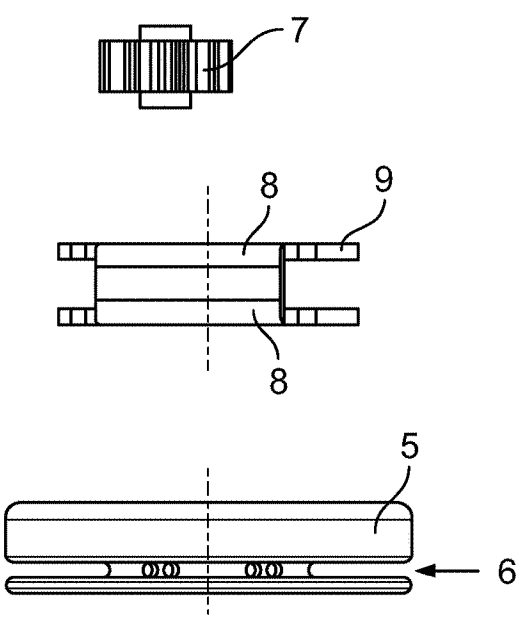
Figure 4E:
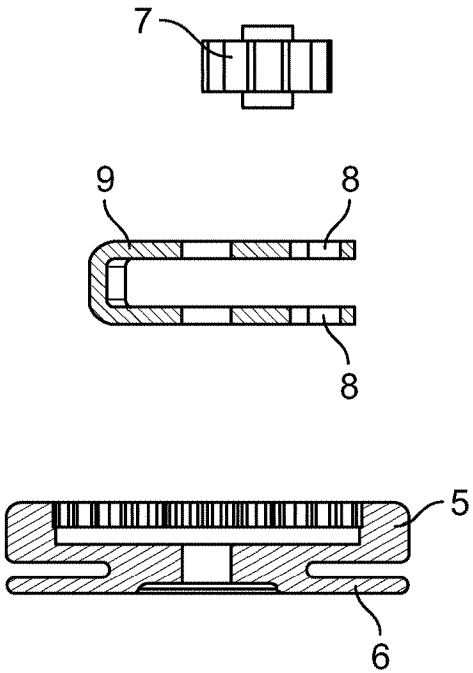
Figure 4E:
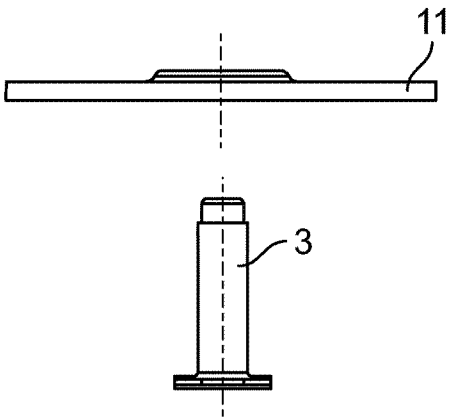
Figure 4F:
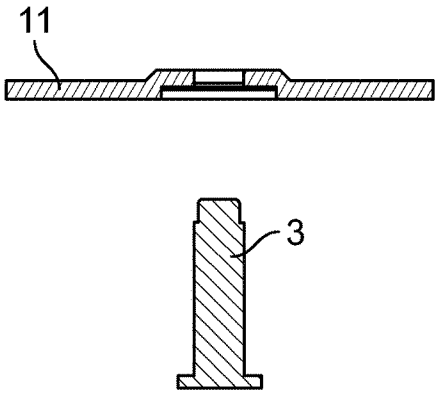

FIG. 4*f* show various side views, top views and sectional views of the components of the embodiment of a rotary closure according to the present disclosure.

In FIG. 1*a* to FIG. 1*d*, an embodiment of a rotary closure 10 according to the present disclosure is shown in various side/plan views and sectional views. The rotary closure comprises a housing part 1 and a rotary knob 2 attached to an axis 3, which rotary know is formed with a kind of external corrugation for better gripping. The rotary knob 2 is fixed to the housing part 1 in such a way that it can be used to actuate a first gear 4 having internal toothing for putting into operation a tensioning pulley 6 inside the rotary closure 10. The axis 3 itself may be fixed or may itself be rotary. A tensioning element not shown in the figures, such as a plastic wire or plastic cable, can be tensioned over the tensioning pulley 6 by winding around the tensioning pulley 6. The tensioning pulley 6 can also be unlocked again to release the closure 10, whereby this is accomplished with a special drive pinion 7. In the embodiments shown, the tensioning pulley 6 is fixedly connected to a second gear 5 with internal toothing. In this embodiment, the tensioning pulley 6 is formed quasi integrally with the second, rotating gear 5, but it can also be formed separately from and connected to it. When the rotary knob 2 is rotated in the closed position, the drive pinion 7, which meshes with the first gear 4 and the second gear 5, rotates the tensioning pulley 6 and thus winds up the tensioning element with a comparatively large transmission ratio. The drive pinion has a much smaller number of teeth compared to the number of teeth of the internal toothing of the gears 4, 5 (cf FIG. 1*c*).

Figure 1A:
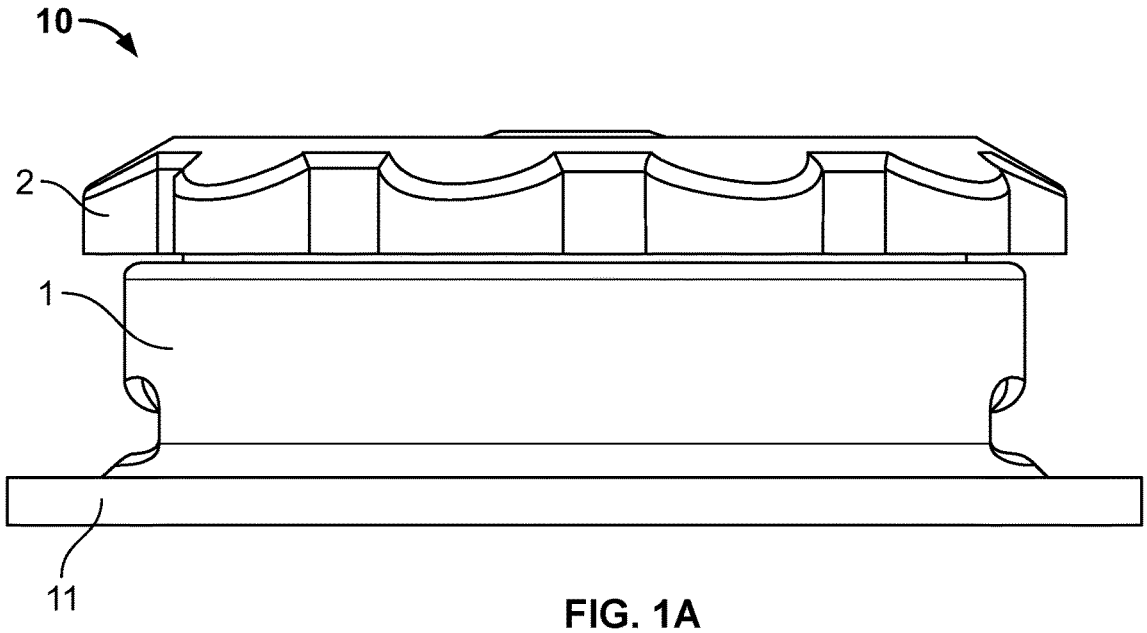
Figure 1B:
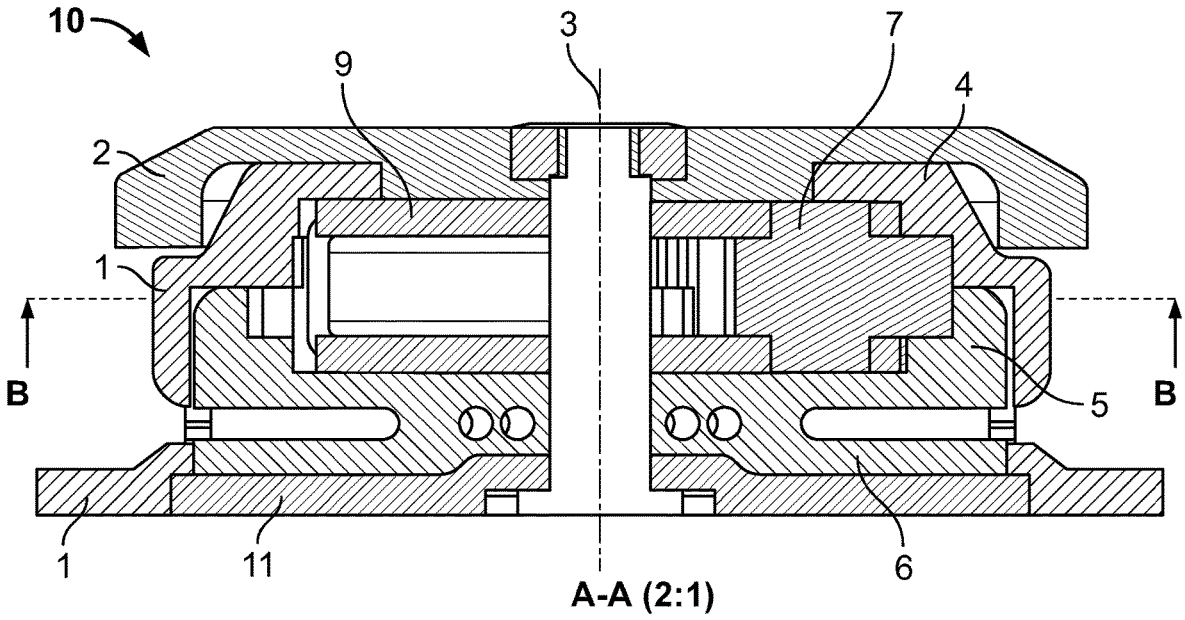
Figure 1C:
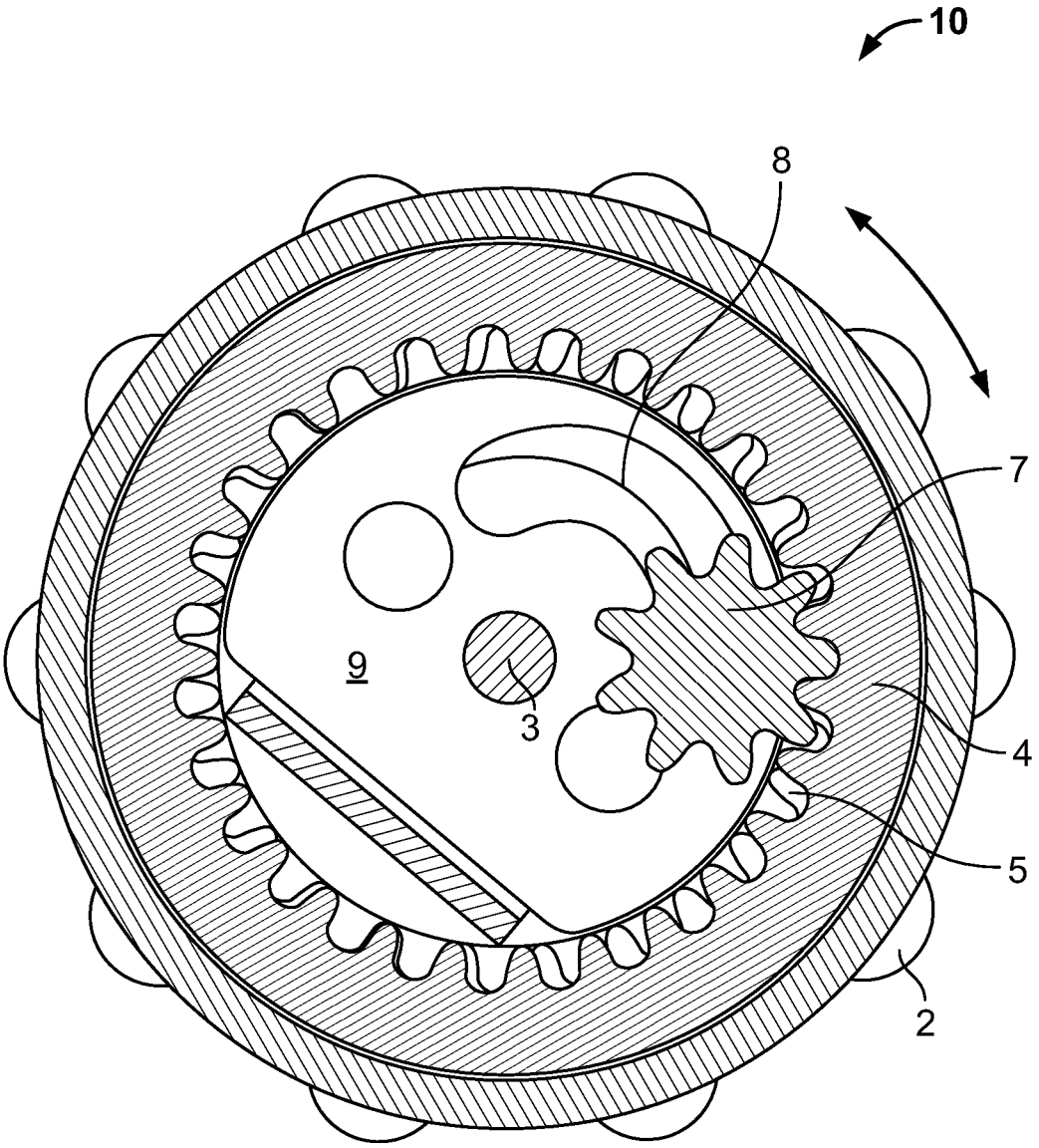
Figure 1D:
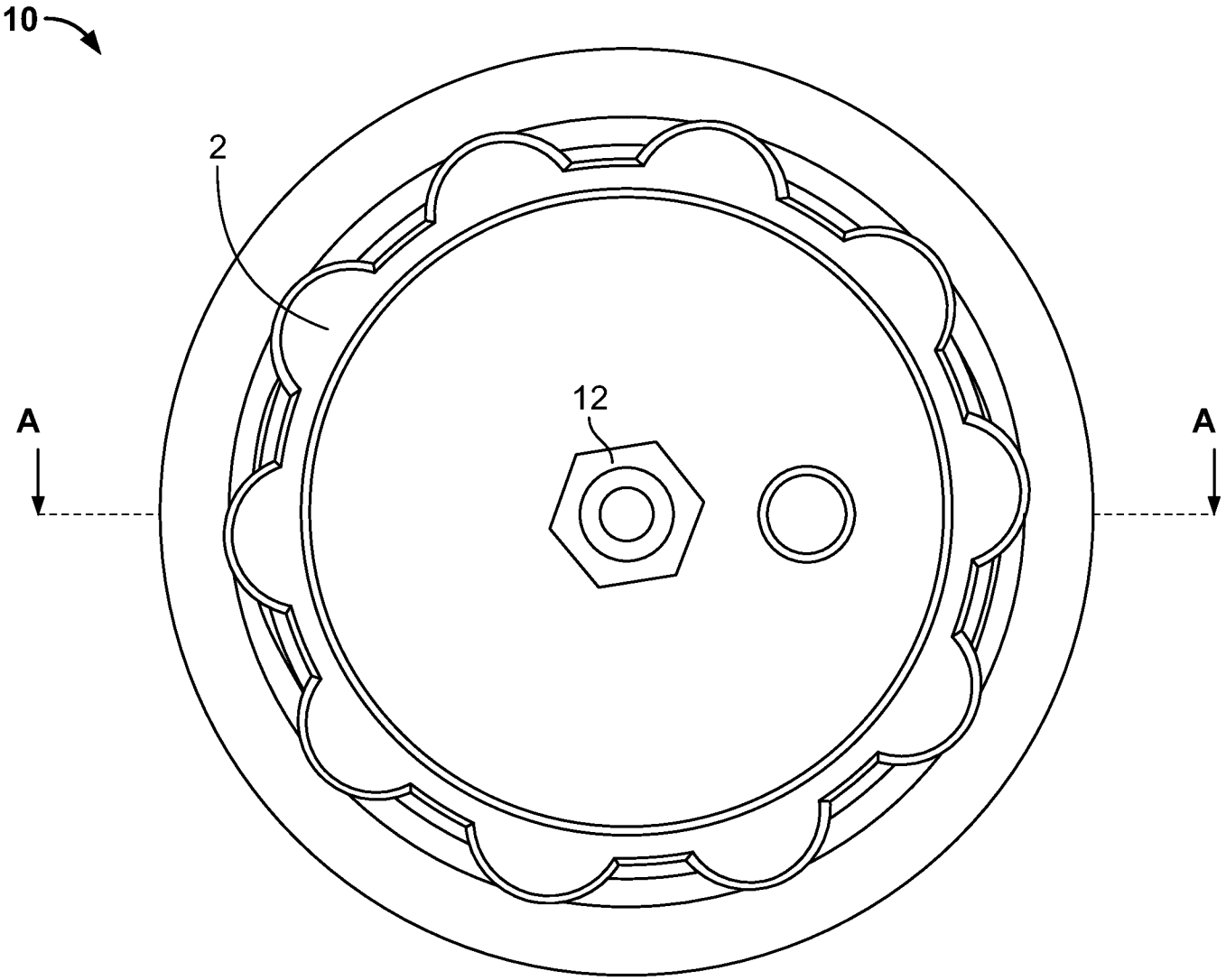
Figure 2:
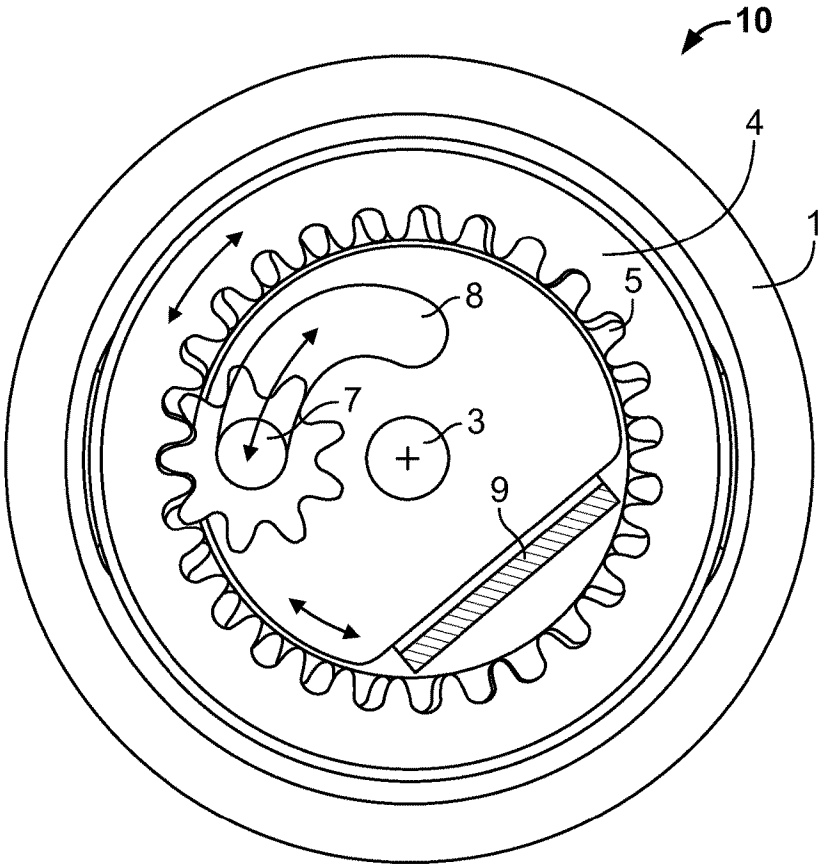
FIG. 2 shows a top view of an internal view of the embodiment of the rotary closure according to the invention to illustrate the interaction between the drive pinion and the groove to displace the drive pinion.

As it can be seen in particular in FIG. 1*b* and FIG. 1*c*, the drive pinion 7 is mounted inside the internal toothing of the gears 4, 5 via a specific type of bearing of the bearing journals of the drive pinion 7. Namely, the drive pinion 7 is not mounted in a fixed position in the rotary closure 10, but is movable and displaceable through an arcuate groove 8 in which the bearing journals of the drive pinion 7 are inserted. The arcuate groove 8 or slot of the recess is provided in an intermediate housing 9 according to this embodiment, which is installed inside the housing part 1 between the gears 4, 5 and is coupled to the rotary knob 2 in a rotationally fixed manner. In this embodiment, the arcuate groove 8 is not concentric with a center of the rotational axis 3, but approaches the rotational axis 3 over its course at least in a partial section. The groove 8 is arranged quasi eccentrically with respect to the rotary closure 10 and the axis of rotation 3, so that when the drive pinion 7 is displaced within the groove 8, the teeth of the drive pinion 7 can be selectively disengaged from engagement with the teeth of the internal toothing of the gears 4, 5. For example, a first portion of the groove 8 is concentric with the axis 3, so as to prevent unintentional opening of the closure 10 when the rotary knob 2 is turned only slightly. Like FIG. 2, FIG. 1*c* shows the engagement position for closing the closure 10. By deliberately moving the drive pinion 7, it is thus possible to engage and disengage the connection with the gears 4, 5 and thus also the tensioning roller 6 of the tensioning element. By simply reversing the direction of rotation, the tensioning element, once tensioned, can thus be immediately released again by the rotary closure 10. As soon as the teeth of the drive pinion 7 move out of their engagement with the teeth of the internal gear toothing, the tensioning element can be easily released by pulling.

Thus, no extra actuating components or parts are required to enable the tension of the tensioning element to be released and thus the rotary closure 10 to be opened. By simply reversing the direction of rotation, as indicated schematically by the arrow in FIG. 1*c*, the rotary closure 10 can be easily opened again. In doing so, the drive pinion is merely automatically displaced radially with respect to axis 3. This ensures a very compact and flat design. The automatic displaceability of the drive pinion 7 in the groove 8 can also take place in a different way than shown in this example, as long as the drive pinion 7 can be moved from an engaged position to a disengaged position (disengaged engagement with internal gears) by changing the direction of rotation on the rotary knob 2.

Alternative designs of such forms of displaceable arrangement of the drive pinion 7 are known to those skilled in the art. For example, instead of an arcuate groove 8, a rectilinear groove may be provided. Instead of a groove 8, a recess or a lever mechanism can also be provided. Also, the bearing arrangement with a displacement possibility of the drive pinion 7 can be realized other than in an intermediate housing 9, for example by direct integration in a part of the gear wheels 4, 5 or of the housing part 1.

FIG. 2 shows in a top view a simplified internal view of the main components of the rotary closure 10 according to an embodiment of the present disclosure. With the arrows it is indicated that by changing the direction of rotation on the rotary knob 2, the rotation of the gear wheel 4 is changed in such a way that the drive pinion 7 moves along the circular groove 8 according to the direction of the arrow and is thus brought out of engagement (opening position) with the internal toothing (closing situation). In FIG. 2, it can also be seen that the number of teeth of the internal toothing of gear 4 and that of gear vary slightly. For example, there is a tooth difference of one between the gears 4, 5, so that when they engage with the drive pinion 7, a kind of self-locking of the rotating components results. This prevents unintentional rotation of the components of the rotary closure 10 in use. In FIG. 2, it can also be seen that the intermediate housing 9 is completely inserted inside the gears 4, 5 and the housing 1 in the form of a U-shaped sheet metal part with the arcuate groove 8. The intermediate housing 9 is firmly coupled to the rotary knob 2 by means of cams and thus forms a drive part with the pinion 7. The drive pinion 7 has a rather large reduction ratio in relation to the internal toothing of the gears 4, 5, for example in the range of 1:3. However, the gears 4, 5 have an equal pitch circle and the drive pinion 7 rotates on a circular path around the stationary gear 4. Thus, if the pinion has nine teeth, the first gear has twenty-seven teeth and the second gear has twenty-four teeth, a total reduction ratio of 1:8 can be realized. However, the number of teeth can vary.

Figure 3:
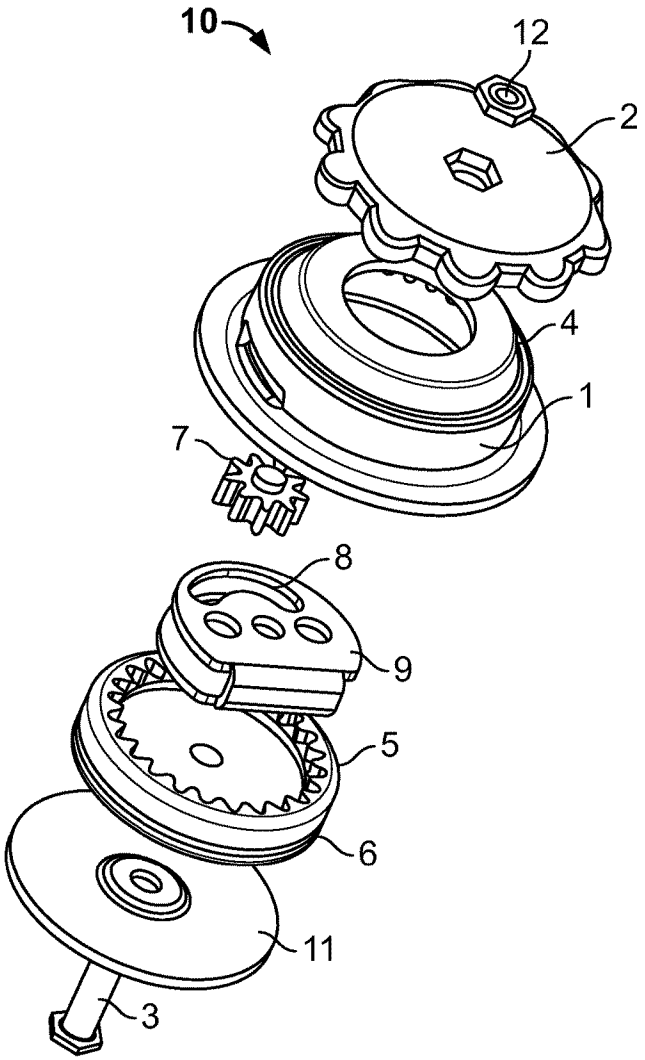
FIG. 3 shows a perspective exploded view of the main components of the embodiment of a rotary closure according to the present disclosure.

FIG. 3 shows a perspective exploded view of the assembly of the components of the embodiment of a rotary closure 10 with displaceable drive pinion 7. The axis of rotation 3 is connected to a kind of base plate 11. Above this is the second gear 5 with the tensioning pulley 6 at the lower area, which is used for winding and tensioning a (not shown) tensioning element, such as a plastic cable. Above this is the intermediate housing 9, in which the circular arc-shaped groove 8 for the variable mounting of the drive pinion 7 with its bearing journal can be seen. Instead of only one groove 8, two 180° opposing grooves 8 could also be provided in the drive part or intermediate housing 9 for larger acting forces. Above this, in turn, the housing part 1 is shown in FIG. 3, which has slot-like openings on the outer sides for the passage of a tensioning element that is wound on the tensioning pulley 6. In this embodiment, the housing part 1 has a kind of hat-shaped form which completely closes off the components from the outside together with the base plate 11. In the housing part 1, in the embodiment example, the first gear 4 with internal toothing is directly integrated. However, it can also be formed separately and connected to the housing part 1. The housing part 1 is in turn coupled to a rotary knob 2 shown above, via which the first gear 4 and the tensioning pulley 6 can be actuated via the second gear 5 when the drive pinion 7 engages (see FIG. 1*c* above). When the rotary knob 2 is turned in the opposite direction, the tension is released due to the displacement of the drive pinion 7, thus opening the rotary closure 10.

FIG. 4*a* to FIG. 4*f* show the individual components and parts of the rotary closure 10 of this embodiment in sectional views and side views. FIG. 4*a* shows the assembled state of the rotary closure 10 according to the embodiment of the present disclosure. FIG. 4*b* shows the rotary knob 2 with the fastening screw 12, and here it has a contoured, ribbed shape on the outside for better gripping. FIG. 4*c* shows the housing part 1 with first gear 4 with internal toothing, which engages with the drive pinion 7. FIG. 4*d* shows the drive pinion 7 with the bearing journals provided on both sides, which are inserted into arcuate recesses, slots or grooves 8 provided for this purpose on the intermediate housing 9. The intermediate housing 9 is realized here as a U-shaped sheet metal part and thus has a very low overall height for a compact form of the rotary closure. The manufacturing costs are also reduced in this way. FIG. 4*e* shows the rotating, second gear 5 with the internal toothing with a slightly different number of teeth compared to the first gear 4 with the purpose of a kind of self-locking between the components 4, 5 and 7. At the lower part of the gear 5, the tensioning pulley 6 is formed integrally with the gear 5, which, however, can also be designed as a separate part. The tensioning element (cable) itself is not shown. FIG. 4*f* shows the base plate 11 and the drive axle 3 mounted through the base plate, around which the components such as the rotary knob 2, the gears 4, 5 and the tensioning pulley 6 rotate for the functioning of the winding of the tensioning element.

The rotary closure 10 according to the present disclosure with the described structure has the advantage that it has a very compact design with a low height in particular. The parts and components are reduced in number and the rotary closure 10 is comparatively light and inexpensive to manufacture. No further actuating elements such as a knob or a lever are required for releasing the tension. Furthermore, with the rotary closure 10 according to the present disclosure, a very large transmission ratio can be realized with a comparatively simple structure, so that a strong tensioning effect is made possible when tensioning shoe parts or similar parts which are not very elastic. The rotary closure functions in the manner of a toothed cardanic gear, such as a cyclo gear, and has the special variable bearing form of the drive pinion 7, by means of which the engagement and disengagement of the toothings of the drive pinion 7 and the gear wheels 4, 5 is accomplished according to the present disclosure.

The invention claimed is:

1. A rotary closure, comprising:

a housing part with an axis, to which a rotary knob is attached in order to actuate a tension roller for a tensioning element for the rotary closure in order to wind or release the tensioning element; and a first gear with internal toothing connected to the rotary knob and a rotating second gear with internal toothing connected to the tension roller, wherein a drive pinion that is coupled to the first and second gears is provided between said first and second gears, and wherein the drive pinion has a mounting that is configured to be displaced radially with respect to the axis in order to selectively, directly couple the drive pinion to and release the drive pinion from the internal toothing of the respective first and second gears.

2. The rotary closure of claim 1, wherein the mounting of the drive pinion is designed to be radially displaceable with a change in a direction of rotation on the rotary knob.

3. The rotary closure of claim 1, wherein the mounting of the drive pinion has an arcuate pitch circle groove which varies in distance with respect to the axis over its course.

4. The rotary closure of claim 1, wherein the mounting of the drive pinion is provided in an intermediate housing inside the housing part.

5. The rotary closure of claim 1, wherein the internal toothing of the first gear has a number of teeth that varies slightly, at least by one tooth, from a number of teeth of the internal toothing of the second gear.

6. The rotary closure of claim 1, wherein the drive pinion has a reduction ratio with respect to the first and second gears, in a range of 1:3 and rotates on a circular path around the first gear.

7. The rotary closure of claim 1, wherein the first and second gears are substantially enclosed by the housing part from outside.

8. The rotary closure of claim 1, wherein the mounting of the drive pinion extends eccentrically relative to a center of the axis.

* * * * *